US008882400B2

(12) United States Patent
Leininger

(10) Patent No.: US 8,882,400 B2
(45) Date of Patent: Nov. 11, 2014

(54) SOLIDS FEEDER DISCHARGE PORT

(75) Inventor: Thomas Frederick Leininger, Chino Hills, CA (US)

(73) Assignee: General Electric Company, Schenectady, NY (US)

( * ) Notice: Subject to any disclaimer, the term of this patent is extended or adjusted under 35 U.S.C. 154(b) by 993 days.

(21) Appl. No.: 12/915,556

(22) Filed: Oct. 29, 2010

(65) Prior Publication Data

US 2012/0107058 A1 May 3, 2012

(51) Int. Cl.

*B65G 53/48* (2006.01)
*F23K 3/02* (2006.01)
*F23N 1/00* (2006.01)

(52) U.S. Cl.

CPC ..... *F23K 3/02* (2013.01); *F23K 2203/006* (2013.01); *F23N 1/002* (2013.01)
USPC ..... 406/71; 406/92; 198/640; 198/642

(58) Field of Classification Search

USPC ..... 406/92, 71; 198/640, 642
See application file for complete search history.

(56) References Cited

U.S. PATENT DOCUMENTS

| | | | | | |
|---|---|---|---|---|---|
| 1,908,220 | A | * | 5/1933 | Chapman | 406/92 |
| 4,019,783 | A | * | 4/1977 | Kayser | 406/144 |
| 4,085,976 | A | | 4/1978 | Edwards et al. | |
| 4,168,864 | A | * | 9/1979 | Weeks | 406/23 |
| 4,302,481 | A | * | 11/1981 | Ribnitz et al. | 427/475 |
| 4,416,610 | A | * | 11/1983 | Gallagher, Jr. | 431/4 |
| 4,480,947 | A | * | 11/1984 | Nagasaka | 406/14 |
| 4,546,902 | A | * | 10/1985 | Anderson | 222/129.2 |
| 4,831,971 | A | * | 5/1989 | Ott et al. | 123/25 A |
| 5,332,312 | A | * | 7/1994 | Evanson | 366/136 |
| 5,505,566 | A | * | 4/1996 | Gruber | 406/12 |
| 5,615,980 | A | * | 4/1997 | Mauchle | 406/19 |
| 5,722,801 | A | * | 3/1998 | Mahoney, Jr. | 406/24 |
| 6,024,639 | A | * | 2/2000 | Scherer et al. | 454/77 |
| 6,213,289 | B1 | | 4/2001 | Hay et al. | |
| 6,488,773 | B1 | * | 12/2002 | Ehrhardt et al. | 118/302 |
| 6,708,715 | B2 | * | 3/2004 | Duebel et al. | 137/102 |
| 6,719,500 | B2 | * | 4/2004 | Pfeiffer et al. | 406/91 |
| 6,857,826 | B2 | * | 2/2005 | Seitz | 406/34 |
| 6,890,093 | B2 | * | 5/2005 | Karp et al. | 366/336 |
| 7,311,474 | B1 | * | 12/2007 | Ogasahara et al. | 406/143 |

(Continued)

FOREIGN PATENT DOCUMENTS

| | | |
|---|---|---|
| DE | 1016397 B | 9/1957 |
| EP | 1916476 A2 | 4/2008 |
| EP | 2213377 A1 | 8/2010 |

OTHER PUBLICATIONS

PCT Search Report and Written Opinion dated Aug. 20, 2013 from corresponding Application No. PCT/US2011/049297.

*Primary Examiner* — Joseph Dillon, Jr.
(74) *Attorney, Agent, or Firm* — Sutherland, Asbill & Brennan LLP

(57) ABSTRACT

The present application provides a solids feeder in communication with a flow of solids and a flow of a conveying fluid. The solids feeder may include an outlet channel with the flow of the solids therein and a discharge port in communication with the outlet channel. The discharge port further may include an inlet in communication with the flow of the conveying fluid and a flow channel. The flow channel may include a reduced cross-sectional area about the outlet channel as compared to the inlet.

16 Claims, 5 Drawing Sheets

(56) References Cited

U.S. PATENT DOCUMENTS

| | | | | |
|---|---|---|---|---|
| 7,530,505 | B2 * | 5/2009 | von Keudell et al. | 239/399 |
| 7,690,834 | B2 * | 4/2010 | Nakamura et al. | 366/172.2 |
| 8,220,982 | B2 * | 7/2012 | Musil | 366/23 |
| 8,506,155 | B2 * | 8/2013 | Musil | 366/7 |
| 2005/0074303 | A1 * | 4/2005 | Morohashi et al. | 406/194 |
| 2005/0281131 | A1 * | 12/2005 | Yungblut | 366/137 |
| 2007/0158476 | A1 * | 7/2007 | Laidler et al. | 239/589 |
| 2008/0060184 | A1 * | 3/2008 | Baarman et al. | 29/596 |
| 2008/0205999 | A1 * | 8/2008 | Rieger et al. | 406/96 |
| 2009/0178338 | A1 | 7/2009 | Leininger et al. | |
| 2011/0030820 | A1 * | 2/2011 | Langevin et al. | 137/560 |
| 2013/0008240 | A1 * | 1/2013 | Ito et al. | 73/61.59 |

* cited by examiner

SOLIDS FEEDER DISCHARGE PORT

TECHNICAL FIELD

The present application relates generally to pneumatic conveying systems and more particularly relates to an improved discharge port for a solids feeder. The solids feeder with the improved discharge port provides a steady flow of solids in pneumatic conveying systems such as those used in gasification systems and the like.

BACKGROUND OF THE INVENTION

Known integrated gasification combined cycle ("IGCC") power generation systems may include a gasification system that is integrated with at least one power producing turbine system. For example, known gasifiers may convert a mixture of a fuel such as coal with air or oxygen, steam, and other additives into an output of a partially combusted gas, typically referred to as synthesis gas or "syngas". These hot partially combusted gases typically are scrubbed using conventional technologies to remove contaminates and then supplied to a combustor of a gas turbine engine. The gas turbine engine, in turn, powers a generator for the production of electrical power or to drive another type of load. Exhaust from the gas turbine engine may be supplied to a heat recovery steam generator so as to generate steam for a steam turbine. The power generated by the steam turbine also may drive an electrical generator or another type of load. Similar types of power generation systems may be known.

These known gasification systems generally require a conveying system to deliver a relatively steady flow rate of coal to the gasifier to ensure consistent performance. One known type of conveying system is a pneumatic conveying system in which finely ground particles of coal are conveyed through a conduit to the gasifier using a flow of gas such as nitrogen, carbon dioxide, or natural gas as the transport medium or carrier gas. The flow rate of coal, or any other type of conveyed solids in a pneumatic conveying system, however, generally may exhibit time varying fluctuations. These solids flow rate fluctuations may be a result of a flow separation between the solids and the carrier gas that can be caused by elements of the pneumatic conveying system itself. For example, sharp bends or changes in cross sectional area of the conduit may cause disruption in the movement of the solids relative to the movement of the gas. Such may lead to some regions of carrier gas that are enriched in solids and other regions that are depleted in solids. In such circumstances, a plot versus time of the flow rate of solids past a fixed point along the conduit may take the shape of an irregular wave form with the peaks representing regions of solids enriched carrier gas and the troughs representing regions of solids depleted gas. Flow rate fluctuations may also be caused by other elements of a pneumatic conveying system such as the solids pressurization equipment. Such equipment, by its very nature, may cause aggregation or agglomeration of particles that can give rise to pulses in solids concentration downstream of the pressurization device. Such an unsteady flow rate, as described above, may lead to poor gasifier control and hence poor gasifier performance in the form of lower carbon conversions and the like.

There is thus a desire for an improved pneumatic conveying system in general and an improved solids feeder in specific. Such an improved pneumatic conveying system and solids feeder may provide a relatively steady flow rate of solids, such as coal, which, in turn, may provide improved overall gasifier performance and, hence, improved power plant performance.

SUMMARY OF THE INVENTION

The present application thus provides a solids feeder in communication with a flow of solids and a flow of a conveying fluid. The solids feeder may include an outlet channel with the flow of the solids therein and a discharge port in communication with the outlet channel. The discharge port further may include an inlet in, communication with the flow of the conveying fluid and a flow channel. The flow channel may include a reduced cross-sectional area about the outlet channel as compared to the inlet.

The present application further provides a method of smoothing a flow of solids leaving a solids feeder via a flow of a conveying gas. The method may include the steps of providing the flow of the conveying gas to a discharge port of the solids feeder, reducing the cross-sectional area of a flow channel through the discharge port so as to increase the velocity of the flow of the conveying gas, merging the flow of solids and the flow of the conveying gas in the flow channel, and breaking up the flow of solids by a shearing action of the flow of the conveying gas.

These and other features and improvements of the present application will become apparent to one of ordinary skill in the art upon review of the following detailed description when taken in conjunction with the several drawings and the appended claims.

BRIEF DESCRIPTION OF THE DRAWINGS

FIG. 1 is a schematic view of a portion of a pneumatic conveying system as may be used with a gasifier and the like.

DETAILED DESCRIPTION

Figure 1:
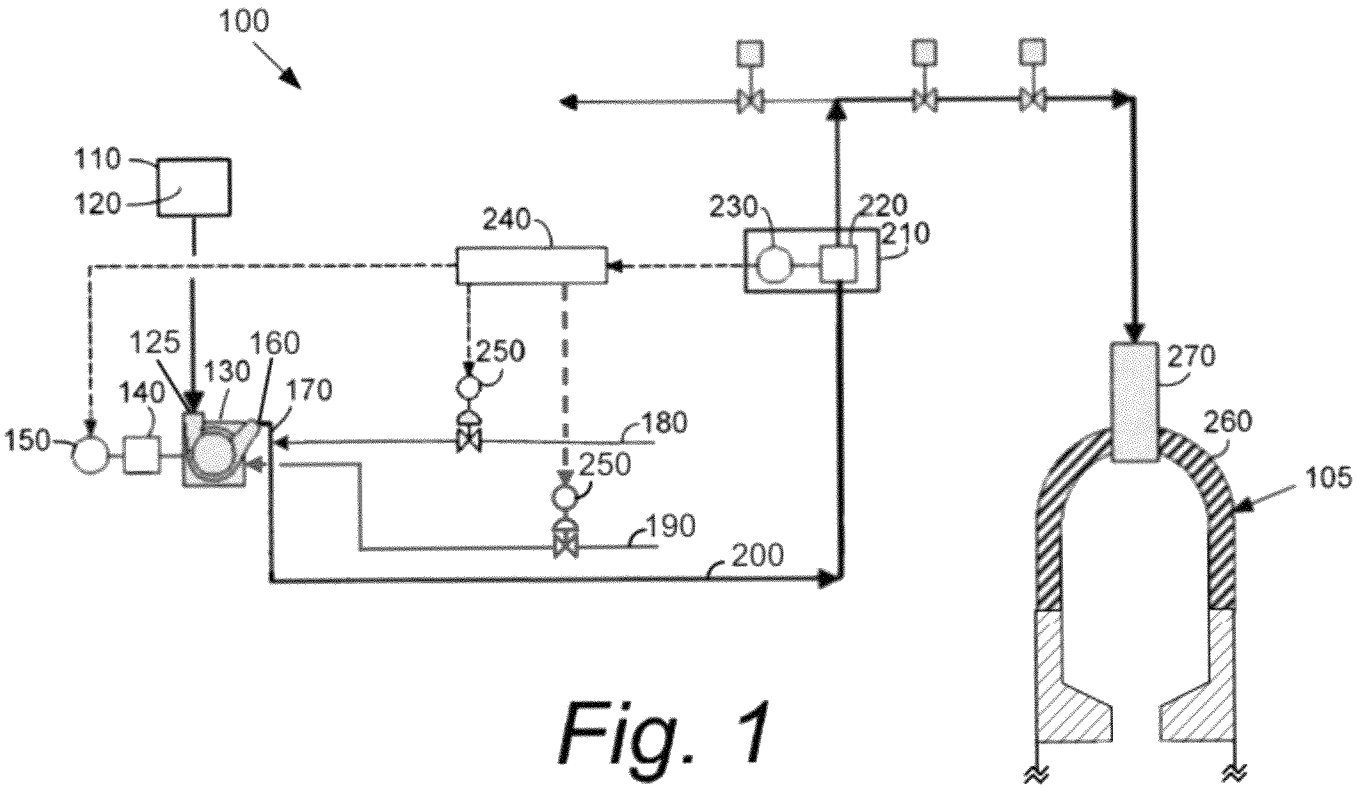

Referring now to the drawings, in which like numerals refer to like elements throughout the several views, FIG. 1 shows portions of a pneumatic conveying system 100 as may be described herein for use with at least a portion of a gasification system 105 and the like. The pneumatic conveying system 100 may include a coal source 110 with an amount of coal 120 therein. The coal source 110 may have any desired size or shape. Likewise, the coal source 110 may contain any type of coal, petroleum coke, solid biomass, other solid carbonaceous fuels, or mixtures thereof (all of which are referred to as "coal 120"). The coal 120 may be ground or otherwise prepared before use including being mixed with other ground particulate matter, such as non-carbonaceous mineral matter, that may be added to enhance the gasification characteristics of the coal in the gasifier.

The pneumatic conveying system 100 may include a solids feeder 130 positioned downstream of and in communication with the coal source 110. The solids feeder 130 may be a rotary, converging channel solids pressurizing and metering device such as the Posimetric® Feeder, a particulate solids pump offered by the GE Energy Division of the General Electric Company of Schenectady, N.Y. Other types of feeders, solids pumps, or other types of conveyance devices may be used herein. In this embodiment, the solids feeder 130 may be driven by a motor 140 with a speed controller 150. The solids feeder 130 may pressurize solids from atmospheric pressure at an inlet 125 of the feeder 130 to pressures well over 1000 psig (about 70 kg/cm$^2$) at a discharge 160 of the feeder 130. Other configurations may be used herein.

The discharge 160 of the solids feeder 130 may be in communication with a flow of conveying gas 180, such as nitrogen, carbon dioxide, natural gas, or gas recycled from a downstream process. Other gases may also be used. The conveying gas 180 mixes with a flow of solids 170 from the discharge 160 of the solids feeder 130 and conveys the solids 170 downstream of the solids feeder 130 via a conduit 200. The solids feeder 130 also may be in communication with a flow of seal gas 190, such as nitrogen, which is injected into the solids feeder 130 in such a way as to prevent any conveying gas 180 from moving backwards through the feeder against the flow of solids 170 and leaking into the atmosphere via the inlet 125.

The pneumatic conveying system 100 further may include a flow meter 210 positioned downstream of the solids feeder 130. The flow meter 210 may be of conventional design that is suitable for measuring the flow rate of pneumatically conveyed solids and may include a flow element 220, a flow transmitter 230, and/or other components. Other types of flow measurement devices may be used herein.

The output of the flow meter 210 may be communicated to a controller 240. The controller 240 may be any type of conventional microprocessor and the like. The controller 240 may be in communication with the speed controller 150 of the solids feeder 130 as well as a number of flow control valves 250 in communication with the flow of the conveying gas 180 and the flow of the seal gas 190. The controller 240 controls the speed of the flow of solids 170 as may be desired. Any other type of control device may be used herein.

The pneumatic conveying system 100 also may include a gasifier 260, only a portion of which is shown. The gasifier 260 may be positioned downstream of the flow meter 210. The gasifier 260 may be of conventional design and may include a fuel injector 270 or other type of intake device. The flow of solids 170 conveyed to the gasifier 260 reacts with oxygen, water, and possibly other reactants to generate a syngas product via well known, controlled chemical reactions.

Figure 2:
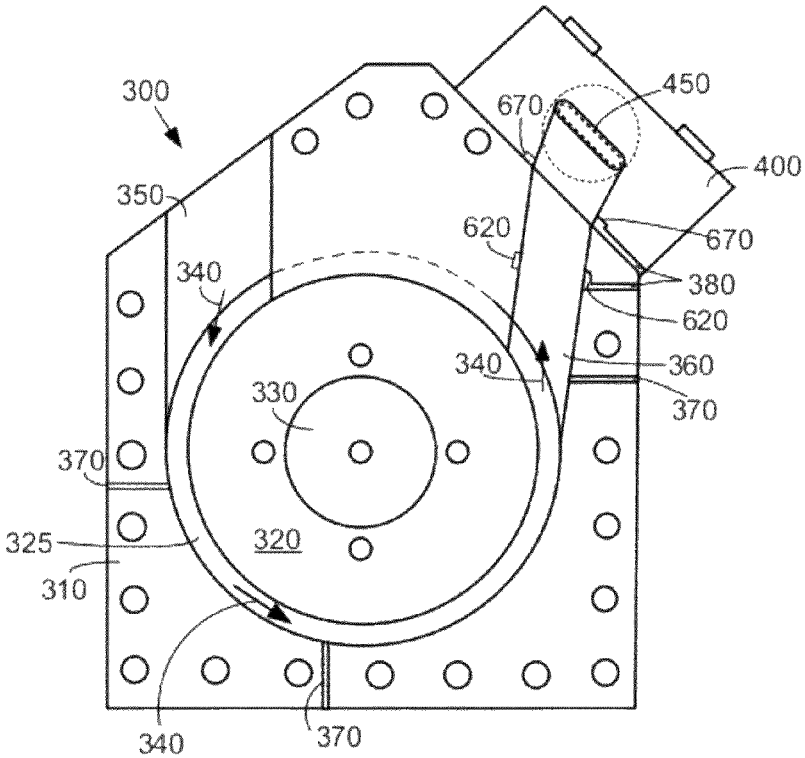
FIG. 2 is a perspective view of a known solids feeder.

FIG. 2 shows a solids feeder 300 as may be described herein. Generally described, the solids feeder 300 is an improvement upon the Posimetric® Feeder described above. The solids feeder 300 includes a feeder body 310. Two or more discs 320 may be mounted on a hub 325 which, in turn, in mounted on a rotating shaft 330 within the feeder body 310. The discs 320, the hub 325, and the rotating shaft 330 may be driven by the motor 140 with the speed controller 150 as is described above. Other types of drive means may be used herein. The inner surface of the body 310, the outer cylindrical surface of the hub 325 and the inner surfaces of the two discs 320 define a flow path 340 for the flow of solids 170 therethrough. Specifically, the flow path 340 may extend from a low pressure inlet channel 350, around the outer surfaces of the hub 325, and to a high pressure outlet channel 360. A number of ports may be positioned about the outlet channel 360. In this example, one or more vent ports 370 for leakage gas and one or more injection ports 380 for a sealing gas such as nitrogen and the like are shown. Other types and configurations of the solids feeder 300 may be used herein.

The outlet channel 360 of the solids feeder 300 may lead to a discharge port 400 as may be described herein. The discharge port 400 may be bolted or otherwise attached to the feeder body 310. The discharge port 400 may be in communication with the flow of conveying gas 180 or other type of conveying medium as will be described in more detail below.

Figure 3:
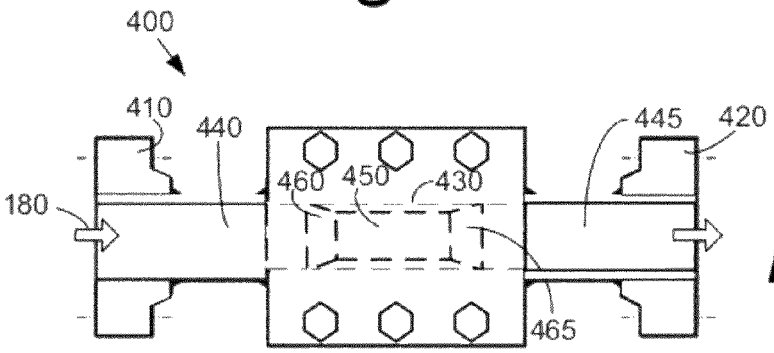
FIG. 3 is a top cross-sectional view of a solids feeder with an improved discharge port as may be described herein.
Figure 4:
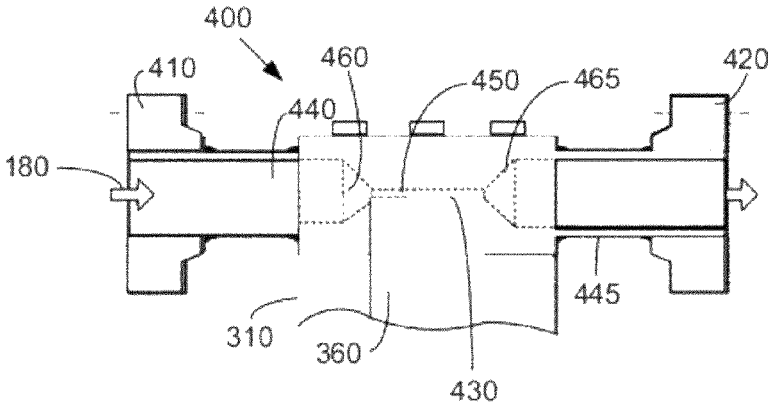
FIG. 4 is a side cross-sectional view of the discharge port of FIG. 3.

FIGS. 3 and 4 show cross-sectional views of the discharge port 400. The discharge port 400 may be connected to the flow of conveying gas 180 via an inlet flange 410 and connected to the pneumatic conveying line 200 at an outlet flange 420. The discharge port 400 may have a flow channel 430 extending linearly from the inlet flange 410 to the outlet flange 420 and intersecting the outlet channel 360 such that the flow of conveying gas 180 picks up the solids emerging from the outlet channel 360 and transports them downstream via the pneumatic conveying line 200.

The flow channel 430 of the discharge port 400 may have largely circular cross-sectional areas about the inlet flange 410 and the outlet flange 420, a circular inlet cross-sectional area 440 and a circular outlet cross-sectional area 445. The circular inlet cross-sectional area 440 and the circular outlet cross-sectional area 445 may or may not be identical. The flow channel 430 also may have a reduced cross-sectional area 450 about the outlet channel 360. In this example, the reduced cross-sectional area 450 may have a relatively narrow rectangular shape with rounded edges but any type of reduced cross-sectional area may be used herein. Transitional cross-sectional areas may be on both sides of the rectangular cross-sectional area 450 so as to connect the circular cross-sectional areas 440 and 445 with the rectangular cross-sectional area 450. A transitional inlet cross-sectional area 460 and a transitional outlet cross-sectional area 465 are shown. The transitional inlet cross-sectional area 460 and the transitional outlet cross-sectional area 465 may or may not be identical.

As the flow of conveying gas 180 enters the discharge port 400 about the inlet flange 410 through the circular inlet cross-sectional area 440, the conveying gas 180 encounters the transitional inlet cross-sectional area 460 and the reduced cross-sectional area 450 of the flow channel 430. The reduced cross-sectional area 450 is much smaller than that of the circular inlet cross-sectional area 440 such that the velocity of the conveying gas 180 may be significantly increased as the conveying gas 180 crosses the outlet channel 360 and picks up the flow of solids 170. The conveying gas 180 thus conveys the flow of solids 170 through the outlet flange 420 and into the conveying line 200.

Any agglomerates of the coal 120 that emerge from the outlet channel 360 may be broken up (de-agglomerated) by the shearing action of the high velocity conveying gas 180 with the reduced cross-sectional area 450 and carried out with the more freely flowing solids also emerging from the outlet channel 360. As the flow channel 430 extends through the transitional outlet cross-sectional area 465 and into the circular outlet cross-sectional area 445 about the outlet flange 420, the increase in the cross-sectional area produces turbulent eddies. Such a turbulent flow may enhance the mixing of the conveying gas 180 and the entrained solids (both the more freely flowing solids and the de-agglomerated solids) within the flow of the solids 170 so as to minimize flow rate fluctuations through the discharge port 400.

Figure 5:
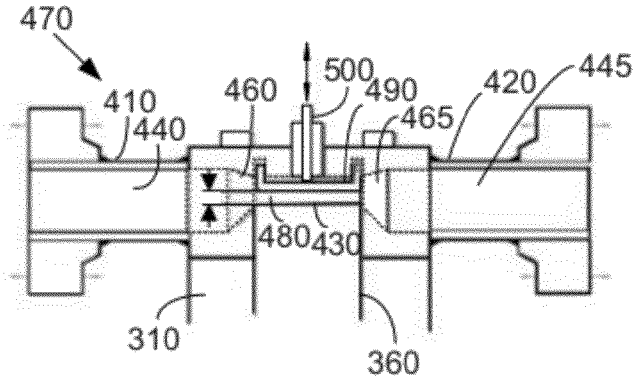
FIG. 5 is a side cross-sectional view of an alternative embodiment of a discharge port.

FIG. 5 shows a further embodiment of a discharge port 470 as may be described herein. The discharge port 470 may be similar to the discharge port 400 described above but with a variably reduced cross-sectional area 480. A moveable plate 490 may be positioned within the variably reduced cross-sectional area 480 of the flow channel 430. Other types of structures may be used herein to vary the cross-sectional area of the flow channel 430. The movable plate 490 may be positioned on a shaft 500 or other type of structure so as to vary the position of the moveable plate 490 within the variably reduced cross-sectional area 480 of the flow channel 430. The moveable plate 490 and the shaft 500 may be positioned via a motor, other types of drive means, or manually set.

When the moveable plate 490 is lowered into the variable reduced cross-sectional area 480, the velocity of the flow of the conveying gas 180 therethrough may increase. Conversely, raising the moveable plate 490 will decrease the velocity of the flow of the conveyor gas 180 therethrough. The movable plate 490 thus may maintain a relatively constant high velocity of the conveying gas 180 even if the flow rate through the solids feeder 300 is reduced, such as during startup and the like. Other configurations may be used herein.

Figure 6:
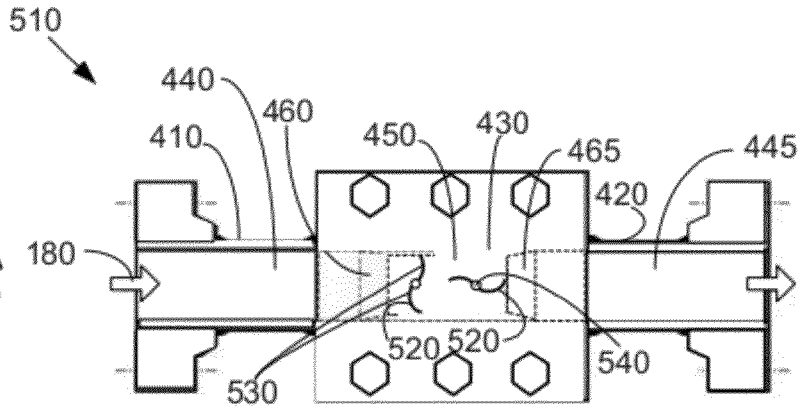
FIG. 6 is a top cross-sectional view of an alternative embodiment of a discharge port.
Figure 7:
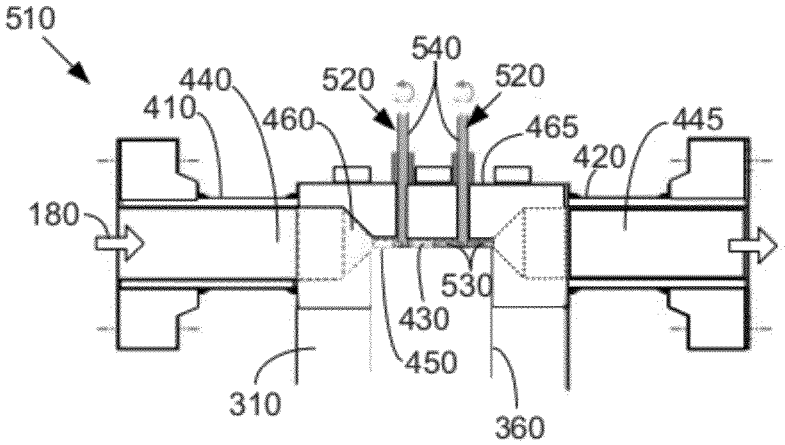
FIG. 7 is a side cross-sectional view of the discharge port of FIG. 6.

FIGS. 6 and 7 show a further embodiment of a discharge port 510 as may be described herein. The discharge port 510 may be largely similar to the discharge port 400 described above, but with the addition of one or more agitators 520 positioned within the reduced cross-sectional area 450 of the flow channel 430. Any number of agitators 520 may be used. The agitators 520 may include a number of blades 530 positioned on a shaft 540 for rotation therewith. Any shape or number of blades 530 may be used. The shafts 540 may be motor driven and/or may be driven by the velocity of the flow of the conveying gas 180 therethrough. The blades 530 of the agitators 520 may continuously sweep within the reduced cross-sectional area 450 of the flow channel 430. The agitators 520 thus assist in the break up of any aggregates within the flow of solids 170 therethrough. Enough clearance between the blades 530 and the walls of the reduced cross-sectional area 450 of the flow channel 430 may ensure that the flow of the conveying gas 180 can always flow therethrough without being blocked. Other types of agitating devices may be used herein.

The use of the discharge port 400, 470, or 510 on the solids feeder 300 thus aids in the break up of any aggregates in the flow of solids 170 as the flow reaches the end of the discharge channel 360 and enters the pneumatic conveying line 200. The flow of solids 170 thus is smoothed out and hence provides improved solids flow rate control.

Figure 8:
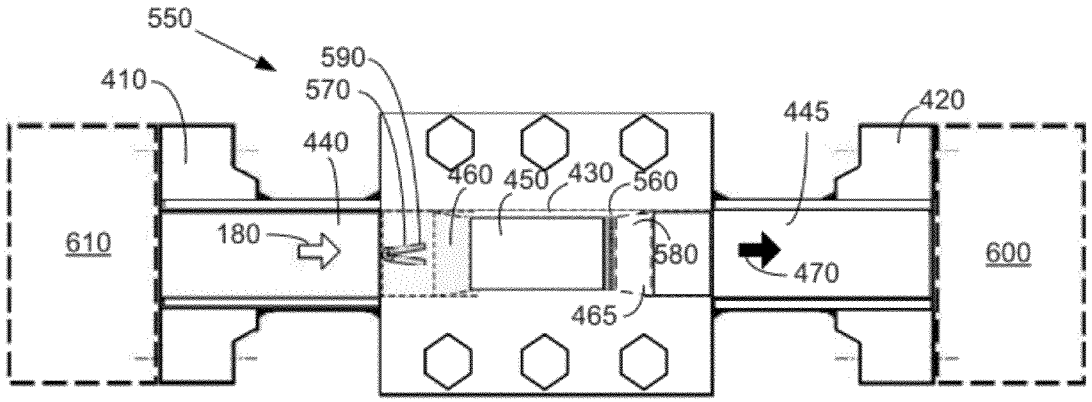
FIG. 8 is a top cross-sectional view of an alternative embodiment of a discharge port.
Figure 9:
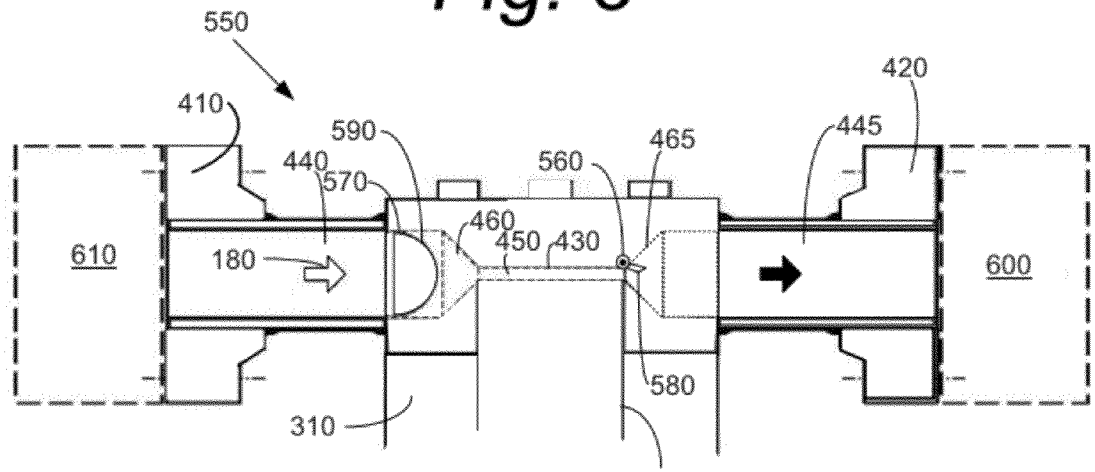
FIG. 9 is a side cross-sectional view of the discharge port of FIG. 8.

FIGS. 8 and 9 show a further embodiment of a discharge port 550 as may be described herein. The discharge port 550 may be largely similar to the discharge port 400 or the other discharge ports described above. The discharge port 550 also may include a downstream check valve 560 positioned downstream of the reduced cross-sectional area 450 of the flow channel 430 and upstream of the outlet flange 420 and an upstream check valve 570 positioned upstream of the reduced cross-sectional area 450 of the flow channel 430 and downstream of the inlet flange 410. Other positions may be used herein.

The downstream check valve 560 may be a flapper valve 580 and the like. Other types of valves may be used herein. In the event of a backflow condition, the downstream check valve 560 may drop down to shut the flow channel 430 and then may be held in place by the pressure of the back flow. The downstream check valve 560 thus may be smaller in size than known check valves that were generally positioned about the outlet channel 360 such that the check valve had to close on top of the flow of solids 170 rising therein. Moreover, the location of the downstream check valve 560 just downstream of the reduced cross-sectional area 450 of the flow channel 430 ensures that the check valve 560 operates under dilute phase flow conditions as opposed to having to operate in conditions where the solids are compacted within the outlet channel 360. Likewise, the downstream check valve 560 may close more tightly given this dilute phase while all of the back flow pressure may be concentrated in a smaller area.

The upstream check valve 570 may include a butterfly check valve 590 and the like. The butterfly check valve 590 may be spring loaded. Other types of valves may be used herein. The upstream check valve 590 thus prevents the flow of solids 170 from entering into the source of the flow of conveying gas 180.

The discharge port 550 also may include a downstream shutoff valve 600 positioned about the outlet flange 420 and upstream shutoff valve 610 positioned about the inlet flange 410. The shutoff valves 600, 610 may include a ball valve, a knife gate valve, and/or other types of valves in any orientation so as to isolate the discharge port 550.

Figure 10:
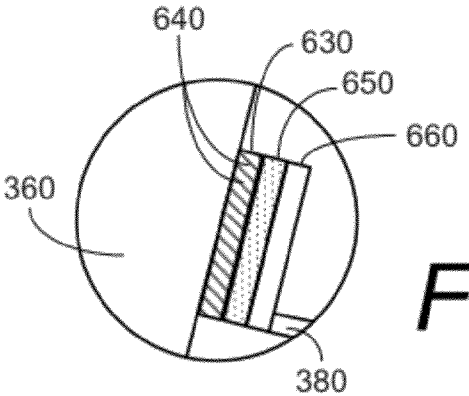
FIG. 10 is a side cross-sectional view of a portion of an outlet channel seal gas distribution ring of FIG. 2.

Referring again to FIG. 2, the solids feeder 300 generally includes one or more nitrogen injection ports 380 positioned about the outlet channel 360. Generally described, nitrogen or other types of inert gasses may be injected therein so as to ensure that any gas leakage back through the flow path 340 may be inert as opposed to toxic or flammable. One option is the use of an outlet channel distribution ring 620 positioned about the outlet channel 360. As is shown in FIG. 10, the outlet channel distribution ring 620 may include a number of layers including an injection layer 630 with a number of small diameter holes 640 positioned therein. The injection holes 640 may be angled in the direction of the flow of solids so as to minimize plugging. The injection holes 640 may be made by laser sintering techniques and other types of manufacturing techniques. A second layer may be a sintered metal porous layer 650. The sintered metal porous layer 650 may provide support for the injection layer 630 while also allowing the nitrogen or other gas to pass therethrough. The third layer may be an open distribution channel layer 660. The open distribution channel layer 660 may convey the nitrogen of other gas from the injection sport 380. Other configurations may be used herein.

Figure 11:
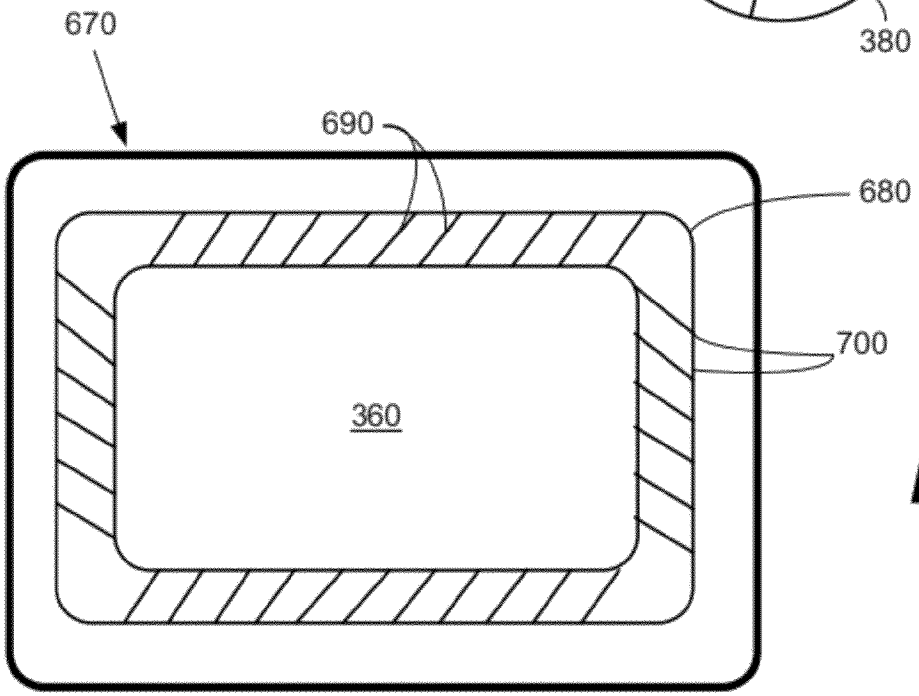
FIG. 11 is a top cross-sectional view of a discharge port seal gas distribution ring of FIG. 2.

A further alternative may be a discharge port distribution ring 670. The discharge port distribution ring 670 may be positioned or incorporated into the bottom surface of the discharge port 400. FIG. 11 shows an example of the discharge port distribution ring 670. The discharge port distribution ring 670 may include an injection layer 680 with a number of holes 690 positioned therein. The injection layer 680 may be surrounded by a distribution channel 700. The distribution channel 700 may be in communication with the injection port 380. The use of the discharge port distribution ring 670 may provide easier access as compared to the outlet channel distribution ring 620. Moreover, depending upon the size of the injection holes 690 and the flow rate of the nitrogen or other gas therethrough, the discharge port distribution ring 670 also may assist in breaking up aggregates in the flow of solids 170 passing through the discharge port 400. Other configurations may be used herein.

It should be apparent that the foregoing relates only to certain embodiments of the present application and that numerous changes and modifications may be made herein by one of ordinary skill in the art without departing from the general spirit and scope of the invention as defined by the following claims and the equivalents thereof.

I claim:

1. A solids feeder in communication with a flow of solids from a solids source and a flow of conveying fluid from a fluid source, the solids feeder comprising:

a feeder body;

a disc disposed within the feeder body, wherein the disc at least partially imparts flow to the flow of solids;

an outlet channel of feeder body with the flow of the solids therein; and a discharge port in fluid communication with the outlet channel, wherein the outlet channel supplies the flow of solids to the discharge port, wherein the discharge port comprises:

an inlet in fluid communication with the flow of conveying fluid, wherein the inlet supplies the flow of conveying fluid from the fluid source to the discharge port; and a flow channel in fluid communication with the inlet and the outlet channel, wherein the flow of conveying fluid passes through the flow channel, wherein the flow channel comprises a reduced cross-sectional area at the outlet channel as compared to the inlet, wherein the flow of solids entering the flow channel at the reduced cross-sectional area is transverse to the flow of conveying fluid flowing through the flow channel at the reduced cross-sectional area, wherein the flow channel comprises a variably reduced cross-sectional area, and wherein the flow channel comprises a moveable plate therein.

2. The solids feeder of claim 1, wherein the inlet comprises a circular inlet cross-sectional area and wherein the circular inlet cross-sectional area is larger than the reduced cross-sectional area.

3. The solids feeder of claim 1, wherein the discharge port comprises an outlet in communication with a conveying line.

4. The solids feeder of claim 3, wherein the outlet comprises a circular outlet cross-sectional area and wherein the circular outlet cross-sectional area is larger than the reduced cross-sectional area.

5. The solids feeder of claim 1, wherein the reduced cross-sectional area of the flow channel comprises a rectangular cross-sectional area.

6. The solids feeder of claim 1, wherein the flow channel comprises a transitional inlet cross-sectional area and a transitional outlet cross-sectional area.

7. The solids feeder of claim 1, wherein the flow channel comprises one or more agitators therein.

8. The solids feeder of claim 7, wherein the one or more agitators comprise a plurality of blades.

9. The solids feeder of claim 1, further comprising a downstream check valve positioned downstream of the flow channel and an upstream check valve positioned upstream of the flow channel.

10. The solids feeder of claim 9, wherein the downstream check valve comprises a flapper check valve.

11. The solids feeder of claim 9, wherein the upstream check valve comprises a butterfly check valve.

12. The solids feeder of claim 1, further comprising one or more shutoff valves positioned about the discharge port.

13. The solids feeder of claim 1, wherein the outlet channel comprises a distribution ring.

14. The solids feeder of claim 13, wherein the distribution ring comprises an injection layer, a porous layer, and an open distribution channel layer.

15. The solids feeder of claim 1, wherein the discharge port comprises a distribution ring.

16. The solids feeder of claim 15, wherein the distribution ring comprises an injection layer and a distribution channel.

* * * * *